US005349937A

United States Patent [19]

Burling

[11] Patent Number: 5,349,937

[45] Date of Patent: Sep. 27, 1994

[54] TORQUE FREE BOW WITH IMPROVED HANDLE GRIP ASSEMBLY

[76] Inventor: Michael R. Burling, 7611 Holstein Rd., Toledo, Ohio 43617

[21] Appl. No.: 1,446

[22] Filed: Jan. 7, 1993

Related U.S. Application Data

[63] Continuation-in-part of Ser. No. 792,392, Nov. 15, 1991, abandoned.

[51] Int. Cl.[5] ..... F41B 5/10

[52] U.S. Cl. ..... 124/25.6; 124/86

[58] Field of Search ..... 124/23.1, 24.1, 25.6, 124/86, 88

[56] References Cited

U.S. PATENT DOCUMENTS

| | | | |
|---|---|---|---|
| 3,397,685 | 8/1968 | Walker | 124/88 |
| 3,407,799 | 10/1968 | Reynolds | 124/24.1 |
| 3,491,739 | 1/1970 | Scrobell | 124/23.1 |
| 3,517,658 | 6/1970 | Shurts | 124/23.1 |
| 3,538,902 | 11/1970 | Fowkes | 124/88 |
| 3,599,621 | 8/1971 | Scrabell | 124/23.1 |
| 4,061,125 | 12/1977 | Trotter | 124/24.1 |
| 4,343,286 | 8/1982 | Thacker | 124/24.1 |
| 4,457,287 | 7/1984 | Babington | 124/23.1 |
| 4,787,361 | 11/1988 | Vyprachticky | 124/88 |
| 4,957,093 | 9/1990 | Hamlett | 124/24.1 |
| 4,966,124 | 10/1990 | Burling | 124/23.1 |

*Primary Examiner*—Randolph A. Reese
*Assistant Examiner*—John A. Ricci
*Attorney, Agent, or Firm*—David C. Purdue; John C. Purdue

[57] ABSTRACT

An archery bow with an offset handle is disclosed. The handle is hingedly connected to the riser of the bow so that the handle is free to pivot relative to the riser and vice versa. This connection prevents torque from being transmitted from the handle to the riser and offers improved accuracy. The connection between the riser and the handle allows rotation about an axis which coincides with the center plane of the bow. There is a substantial offset between the handle and the center plane of the bow. The offset provides substantial arm clearance and permits construction of the bow to accommodate remarkably short brace heights. Preferably, an arm brace is attached to the handle. An improved bow having such offset handle as well as reduced brace height and increased power stroke and increased standard rated velocity is also disclosed. A riser modification is taught wherein the limb angle is maintained to achieve the increases in power stroke and standard rated velocity.

8 Claims, 5 Drawing Sheets

TORQUE FREE BOW WITH IMPROVED HANDLE GRIP ASSEMBLY

REFERENCE TO RELATED APPLICATION

This is a continuation-in-part of application Ser. No. 07/792,392 filed Nov. 15, 1991, now abandoned.

BACKGROUND OF THE INVENTION

1. Field of the Invention

The present invention relates generally to the field of archery bows and, more specifically, to grip assemblies for bows and bows with reduced brace heights.

2. Description of the Prior Art

U.S. Pat. No. 4,966,124 discloses my invention of a torque free grip assembly for archery bows. Briefly, this patent discloses a riser grip assembly which pivots freely so that an archer is prevented from applying torque to the bow through the riser, thereby eliminating a source of error which would otherwise arise during release. Other disclosures of pivoting or rotating grip assemblies are contained in U.S. Pat. Nos. 3,397,685, 3,407,799, 3,538,902 and 3,599,621.

U.S. Pat. No. 4,457,287 discloses an archery bow with a forward mounted, universally mounted handle assembly. When the bow is at rest, the handle is held tightly against universal movement and, when the bow is drawn, the handle is freed for limited universal movement. The bow incorporating the handle assembly has an extraordinarily long brace height. The applicant's understanding of the forces which react in the bow according to the disclosure of this patent is represented in FIG. 6 which is labelled prior art. The handle H is mountable on a handle frame supported on the bow B and the position of the handle H can be adjusted, left or right, relative to the frame as suggested by the small rectangles shown in dotted lines on either side of the handle H shown in FIG. 6. When a draw force F1 is applied to the bow B, the handle frame and the handle are freed for limited universal pivoting movement relative to the riser and the reactive force F2 applied through the universal joint UJ will center the handle H and cause it to align with the center plane of the bow B. Accordingly, it is believed that, regardless of whether the handle is mounted in the middle of the handle frame or on one of the sides of the handle frame, the amount of arm clearance when the bow is drawn, will be the same.

U.S. Pat. No. 4,061,125 discloses a device for positioning a bowstring in a preloaded condition.

U.S. Pat. No. 4,343,286 discloses an archery bow with a combination hand grip and forearm brace which is mounted for pivotable movement about a point in the center plane of the bow. The hand grip is adjustable in that it can be positioned in various positions relative to the brace for a desired draw length.

U.S. Pat. No. 4,787,361 discloses an archery bow with a pivoted handgrip and forearm protector. The handgrip and forearm protector are secured to the bow through a pivot which is positioned in the center plane of the bow and the handgrip extends laterally from the riser.

U.S. Pat. No. 4,957,093 discloses compound bow with a pistol grip. The pistol grip handle acts on the riser through pivot points. The position of the pistol grip is adjustable to suit various archers.

In bowhunting, the speed of an arrow is a critical factor, which, along with accuracy, plays a major role in determining whether the bowhunter will be successful or not. Compound bows, generally, have made a terrific contribution to arrow speed (and accuracy) by increasing the stored energy of bows having a given peak draw force. Upon release, the full weight of the bow is brought to bear upon the arrow and, typically, this weight is much greater than that which an archer could otherwise hold comfortably during aiming.

In an effort to achieve increased arrow speed, manufacturers have decreased the brace height, gradually. Although increases in arrow speed have been achieved through incremental shortening of the brace height, i.e., the distance between the string and the low or pivot point of the bow handle where it is braced in an archers hand, there is a natural limit to minimum brace height in conventional bows and this limit is imposed by the need for a certain amount of arm clearance. Typical brace heights of nine inches have been reduced, over the last ten or twenty years, to something like seven inches. As the brace height decreases, the length of the power stroke increases. The arrow is acted upon over a longer distance and, for a given weight bow, a longer power stroke can mean a faster arrow speed. A limiting factor in this trend has been the need to provide clearance between the string and the arm which is used to hold the bow. That is, upon release of a drawn bow, there must be enough clearance so that the string will not strike and injure the arm which is supporting the bow. A seven inch brace height is regarded as the minimum brace height for providing sufficient arm clearance.

In the field of archery and especially bowhunting, there remains a need for a bow which is capable of imparting higher speed to an arrow upon release, without sacrificing accuracy and arm clearance.

Accordingly, it is an object of the present invention to provide a bow and grip assembly with a substantially reduced (by comparison with prior art bows) brace height and a correspondingly longer power stroke.

It is a further object of the present invention to provide a bow which will impart greater velocity to an arrow upon release, than prior art bows.

It is yet a further object of the present invention to provide a bow in which torque applied to the handle during drawing will not be transmitted to the riser.

It is still a further object of the present invention to provide a bow with plenty of arm clearance.

SUMMARY OF THE INVENTION

The instant invention is based upon the discovery of an improved riser grip assembly for archery bows and a bow including the improved riser assembly and having a longer power stroke. According to the invention, a torque free grip assembly is provided and the low or pivot point of the grip or handle is offset from the center plane of the bow a small but substantial distance. As a consequence, there is more arm clearance and a bow including a grip according to the invention can be manufactured to have a brace height of a small as three to four inches, or, when combined with an appropriate string stop, brace heights of virtually zero inches can be achieved in a bow according to the present invention. Reduced brace height is combined, in a bow according to the present invention, with limb pivots which are positioned forward of their conventional positions to provide a substantial increase in the distance of the power stroke, resulting in significant increases in arrow velocity, by comparison with conventional bows.

Accordingly, it is an advantage of the present invention that it provides arm clearance to accommodate almost any brace height, including virtually zero when an appropriate string stop is provided.

It is a further advantage of the present invention that, for a bow with a given draw weight, it can impart greater speed to an arrow than prior art bows of comparable draw weight.

It is a further advantage of the present invention to provide a bow with an increased power stroke and increased arrow velocity capabilities by providing a brace height which is a given length less than seven inches and by offsetting the limb pivots forward of their conventional positions by a distance which is at least a substantial portion of the given length.

It is a further advantage of the present invention that substantially no torque will be transmitted from the handle to the bow at any time during use.

It is yet a further advantage of a bow according to the invention that an arm brace can be used to distribute the force required to cancel a moment of rotation at the handle of the bow, with the resultant advantage that the arm brace will maintain clothing in an out of the way position.

These and other objects and advantages of the present invention will no doubt become apparent to those skilled in the art after having read the following detailed description of the preferred embodiment which are contained in and illustrated by the various drawing figures.

DETAILED DESCRIPTION OF THE PREFERRED EMBODIMENT

Figure 1:
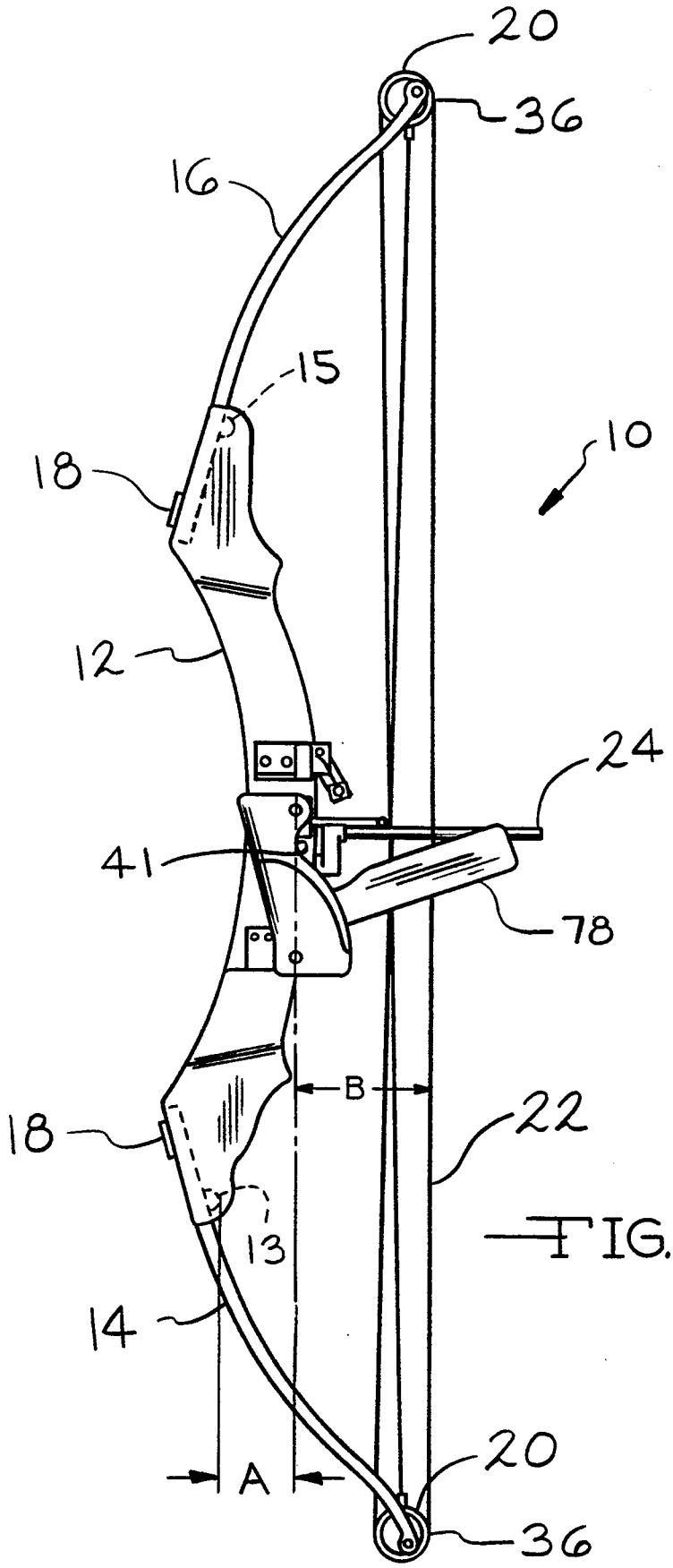
FIG. 1 is a side view of an archery bow according to the present invention.

An archery bow illustrating the present invention is indicated generally at 10 in FIG. 1. The bow 10 is a compound bow although the present invention is not necessarily limited to the field of compound bows. The bow 10 comprises a riser 12, lower and upper limbs 14 and 16 secured to the riser by fasteners 18, compound cams 20 and a string 22 supported on the cams 20. A conventional bar 24 for providing cable clearance is illustrated, although it forms no part of the present invention. The bar 24 is supported in a bracket 26 which, in turn, is secured to the riser 12 in any suitable fashion.

Figure 2:
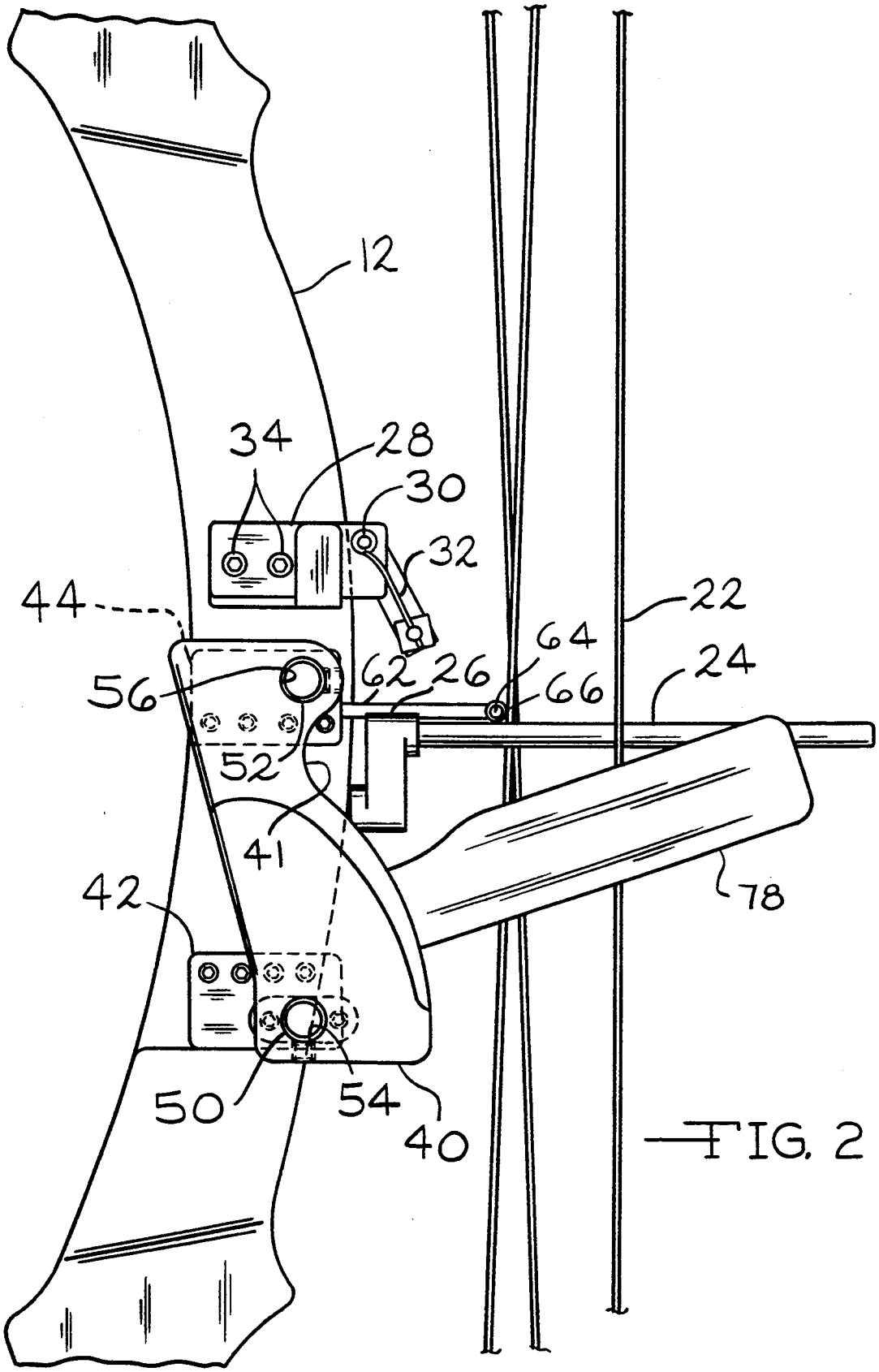
FIG. 2 is a close up view of the riser and grip assembly of the archery bow shown in FIG. 1.
Figure 3:
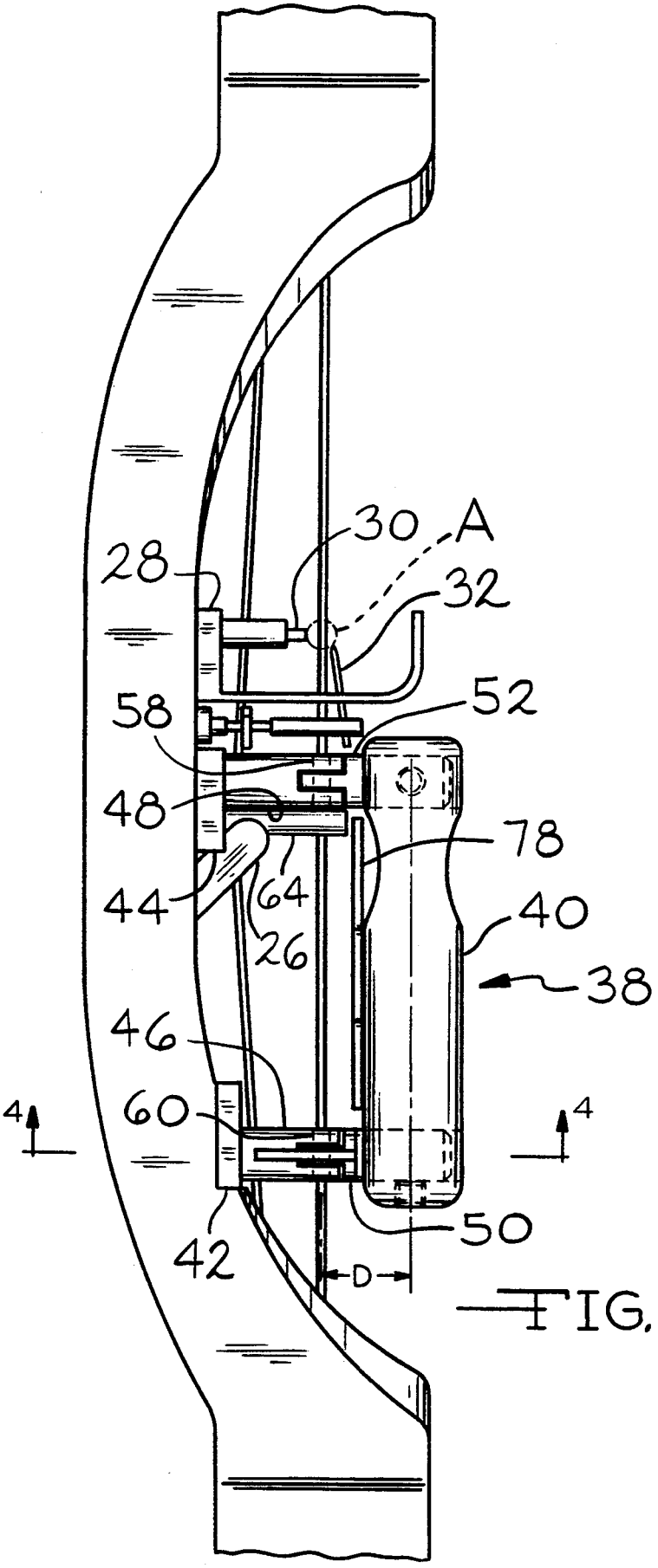
FIG. 3 is a front view of the riser and grip assembly shown in FIG. 2.

The riser 12 and associated components are shown in more detail in FIGS. 2 and 3. An arrow rest bracket 28 supports an arrow rest comprising two arrow rest elements 30 and 32. The arrow rest element 30 is a conventional piston plunger type and arrow rest elements 32 is a conventional, shoot through type. The bracket 28 is secured to the riser 12 by fasteners indicated at 34. Other types of arrow rests may be employed in connection with the present invention. The arrow rest supports the shaft of an arrow A in the position indicated by the dotted lines in FIG. 3. It will be appreciated that the shaft of the arrow A is centered in that, with the arrow knocked, the shaft A extends in the center plane of the bow 10. The center plane is defined by the points 36 where the string 22 tangentially touches the track in the cams 20, and in the case of the bow 10, as described in more detail below, the center plane is defined by a third point or line, namely, the points coinciding with pins 58 and 60. The center plane also corresponds, in the case of the bow 10, with the line coinciding with the centerline of the arrow shaft A when the arrow is knocked as shown in FIG. 3.

As clearly shown in FIG. 3, the central portion of the riser 12 is curved and is offset from the center plane of the bow 10. Other riser designs can certainly be combined in a bow according to the invention. The bow 10 includes a grip assembly, indicated at 38, which acts through the center plane of the bow 10. The grip assembly 38 is connected to the riser 12 and terminates in a handle 40 with a center plane which is offset from the center plane of the bow 10, a distance D which is substantial in accordance with the invention, but would not normally exceed one and one half to two inches. Preferably, the distance D is one quarter of an inch to one and one quarter inches. The distance D is to be measured in terms of a direction which is perpendicular to the center plane of the bow 10. The offset distance D is to be measured between the low or pivot point 41 of the handle 40 and the center plane of the bow 10. The amount of offset in a bow according to the present invention is substantial, in the sense that it is enough to provide significantly increased arm clearance. As explained below, a bow having increased arm clearance in accordance with the invention can accommodate a shorter brace height.

In addition to the handle 40, the grip assembly 38 comprises a pair of lower and upper riser brackets 42 and 44, lower and upper riser hinge rods 46 and 48 which are rigidly supported on said lower and upper riser brackets 42 and 44, and lower and upper handle hinge rods 50 and 52 which arc rigidly supported on said handle 40. In the preferred embodiment, the rods 50 and 52 extend through and are secured in lower and upper bores 54 and 56 (FIG. 2.) which extend through said handle 40.

The upper riser hinge rod 48 is hingedly connected by a pin 58 (FIGS. 3 and 4) to the upper handle hinge rod 52. In like manner, the lower riser hinge rod 46 is hingedly connected by a pin 60 to the lower handle hinge rod 50. According to the invention, the pins 58 and 60 are positioned so that they coincide with the center plane of the bow 10. In other words, when a bow according to the invention is drawn and the draw weight of the bow is resisted by an opposite force acting through the pins, the string will remain in the plane defined by the points coinciding with the pins 58 and 60 and the points 36 where the string touches tangentially the groove in the cams. When the bow 10 is held by the handle 40 and the string 22 is drawn, the force which flexes the limbs is reacted through the pins 58 and 60 which, as indicated above, are in the center plane of the bow 10. Further, the pins 58 and 60 permit relatively frictionless rotation as between the upper riser hinge rod 48 and the upper handle hinge rod 52 as well as between the lower riser hinge rod 46 and the handle hinge rod 50 so that no significant torque is or can be transmitted from the handle 40 to the riser 12 or vice versa. As a consequence, and as explained in U.S. Pat. No. 4,966,124 and my co-pending application Ser. No. 07/538,663 filed Jun. 15, 1990 now U.S. Pat. No. 5,081,979, both of which are incorporated herein by reference, the arrow direction and the sighting direction will always coincide. In this manner a common source of inaccuracy is eliminated. It will be readily appreciated that other pivot means, besides the handle hinge rods, riser hinge rods and pins, may be readily employed in a bow according to the present invention to achieve the objects and advantages set forth above. The specific pivot means and other comparable pivot means are all contemplated within the scope of the invention. As clearly shown in FIGS. 1 and 2, the low or pivot point 41 of the handle 40 is coincident with a plane (not shown) which is perpendicular to the center plane of the bow and passes through the hinge pins 58 and 60.

It will be appreciated that, by offsetting the handle of a bow 10 according to the present invention, more arm clearance is provided. Consequently, I have determined that the brace height, i.e., the distance, indicated at "B" in FIG. 1, between the string 22 and the handle 40 can be shortened significantly. I have determined that, with an offset distance D of only three eighths of an inch, a brace height of as small as four inches can be accommodated in a bow according to the present invention. Even shorter brace heights can be accommodated if the amount of offset is increased slightly. I have also determined that a reduction of the brace height from a conventional seven inches to four inches does not, by itself, produce an increase the velocity of arrows upon release from the bow 10. However, I have further determined that a substantial increase in arrow velocity can be and is achieved when the brace height is set at a given distance less than the conventional seven inch brace height and the limbs 14 and 16 are secured to the riser 12 so that they act or pivot about limb pivots 13 and 15 (FIG. 1) which are positioned forward of the conventional position for such limb pivots. Substantial increases in arrow velocity have been achieved in the case of a bow having a brace height "B" of four inches and where the limb pivots 13 and 15 are positioned three inches forward of their conventional position. In other words, the limb pivots 13 and 15 are positioned three inches forward of their standard position and the standard or conventional brace height of seven inches is reduced the same amount, i.e., three inches. Stated yet another way, it is preferred that brace height is reduced, in a bow according to the present invention, a given distance from the standard seven inches, by positioning the limb pivots forward from their conventional position a distance which corresponds with the given distance. I have used a chronograph to determine that, for each inch that the brace height is reduced in this manner, with other bow components being the same, the standard velocity rating of the bow is increased approximately 6 to 8 feet per second. It will be appreciated that one can reduce the brace height of a bow, for example, by changing the angle of the limbs and the length of the string and cables. I have determined, however, that reducing the brace height in this manner does not increase the standard velocity rating of the bow. In other words, a bow with an increased standard velocity rating, according to the invention, is one which has a brace height which is a given mount less than seven inches and a limb to riser connection in which the limb pivots are positioned forward of their conventional position by the given amount or at least a substantial portion thereof.

According to my invention, a bow can have a brace height of even less than four inches, although this generally requires the use of string control means for preventing undesired impact resulting from over travel of the string 22. One example of such string stop means, in the form of an "L" shaped stop, are illustrated in FIGS. 2 and 3. The "L" shaped stop comprises a first leg 62 (FIG. 2) which is firmly and rigidly supported in the upper riser bracket 44 and extends rearwardly from the riser bracket 44. The stop further comprises a second leg 64 which is connected to the first leg 62 and extends perpendicularly therefrom across the bow 10 so that it extends across the center plane of the bow 10. Preferably, a force absorbing component, in this case, a sleeve 66 made of resilient material, is mounted on the second leg 64. When the string strikes the second leg 64 with the sleeve 66 on it, further forward movement of the string 22 will be resisted.

Figure 4:
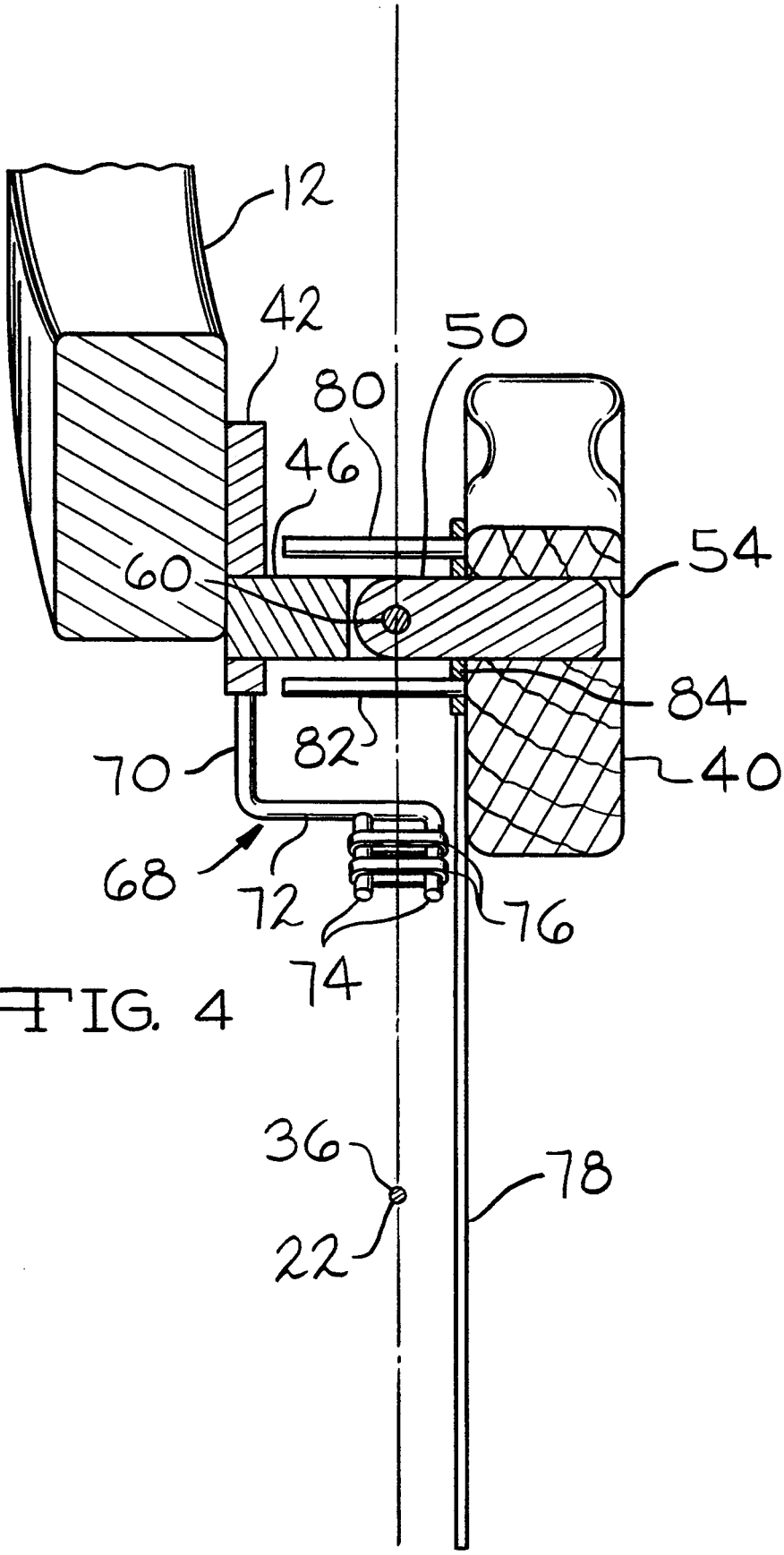
FIG. 4 is a partial sectional view taken along the lines 4—4 in FIG. 3

A second type of string stop is illustrated in FIG. 4 and it is indicated generally at 68. The string stop 68 is attached to and supported on the lower riser bracket 42 although it can alternatively be connected to the upper riser bracket or, for that matter, it can be supported on the riser 12 or anything connected to it. The string stop comprises an "L" shaped support bracket comprising a first leg 70 and a second leg 72. The first leg is connected to the riser bracket 42 and the second leg 72 is connected to the first leg 70 and also to bracket arms 74 which are supported on the second leg 72 so that one arm 74 is on each side of the center plane of the bow 10. In this way, resilient force dampers 76 are supported on the arms 74 and extend across the center plane of the bow 10. Good results have been achieved with force dampers consisting of rubber bands supported on arms comprising threaded bolts. Best results were achieved when the arms 74 were supported so that they extended in a direction which formed an angle of approximately forty five degrees relative to the string 22 in an at rest position as shown in FIG. 1. Specifically, other angular orientations of the arms 74 were tried and when the arms 74 were parallel to the string 22 at rest, there was a loud noise emitted at impact between the string and the resilient force dampers. When the arms 74 were positioned so that they were perpendicular to the string 22 at rest, the rubber bands that were closest to the string 22 broke after a relatively few impacts. Accordingly, it is preferred that the arms be oriented diagonally with respect to the string and by diagonally, it is meant at an angle such that there is a small or negligible noise at impact and the force dampers 76 last a reasonable length of time. With force dampers other than rubber bands, orientations other than diagonal may achieve the low enough noise generation as well as adequate life. It is believed that a single, wide rubber band may be the best candidate for use as force dampers in a string stop of the type shown in FIG. 4. Depending upon the brace height and other details of construction of the bow 10, it may be desired to have the force dampers positioned closer to or farther from the string 22 at rest. This can be readily accomplished, for example, by changing the length of the first leg 70. In fact, a brace height of virtually zero is achievable with the use of the string stop shown in FIG. 4 or something comparable. In order to achieve the minimum brace height, the bow would be modified to position the string, at rest, at or forward of the handle. Various ways of carrying out this type of modification are known and are clearly within the knowledge of those skilled in the art. By way of example, the string length, the limb configuration, the connection between the limbs and the riser, can all be modified, alone or in combination, to change the brace height. The present invention resides, in one sense, in providing the needed arm clearance which is also required to shorten the brace height. The shortest brace height may be achieved, according to the invention, by positioning the string stop adjacent to the handle and reducing the brace height to a point where, with the string at rest, the string stop and specifically, the force dampers 76, deflect the string 22 rearwardly, thereby preloading the string.

Figure 5:
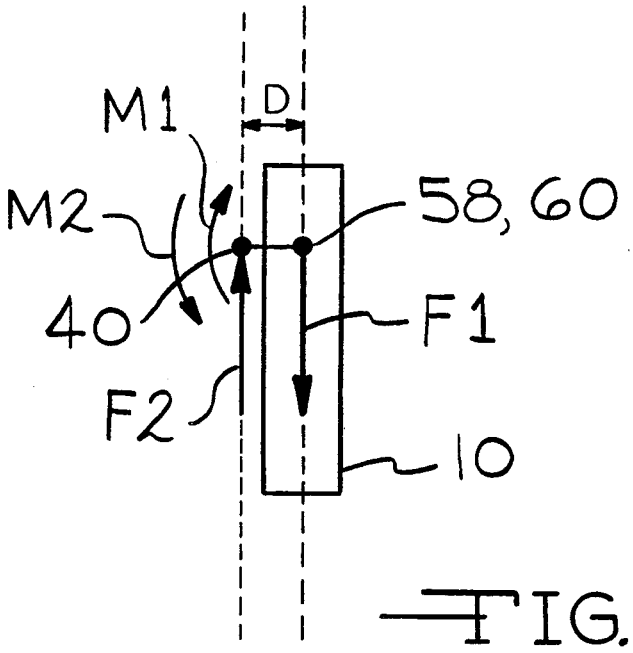
FIG. 5 is a diagram illustrating vector forces in a bow including a grip assembly according to the present invention.
Figure 6:
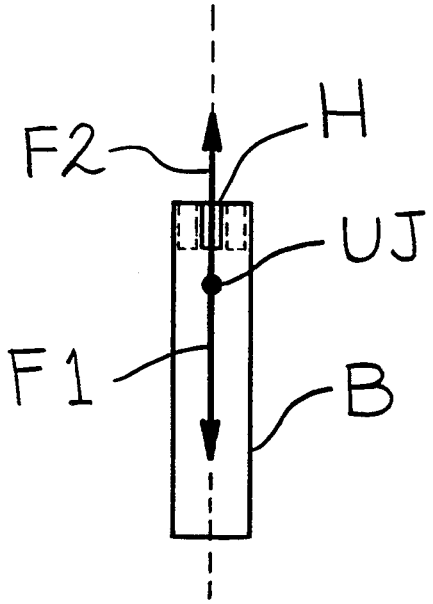
FIG. 6 PRIOR ART
FIG. 6 is a diagram illustrating vector forces in a bow including a prior art grip assembly.

As discussed above, virtually frictionless rotation is provided between the upper riser hinge rod 48 and the upper handle hinge rod 52 as well as between the lower riser hinge rod 46 and the handle hinge rod 50. Consequently, the handle 40 can pivot about the pins 58 and 60 relative, to the riser. In other words, when the bow is drawn, a force F1 (FIG. 5) acts through pins 58 and 60 in the center plane of the bow 10 and it is resisted by an equal force F2 which is applied to the handle 40 and transmitted to the pins 58 and 60 by the upper and lower handle hinge rods 50 and 52. Because of the offset D between the center plane of the handle 40 and the pins 58 and 60, there is a moment, indicated by an arrow M1, which acts to rotate the handle 40 in the direction indicated by the moment arrow M1. In order for the bow to remain stationary through drawing and aiming, the moment represented by arrow M1 must be counteracted and this can be done in one of three ways according to the present invention. The first way entails an archer applying a twisting force to the handle 40 in the direction indicated by the moment arrow M2. A second way entails the application of a counter force to an arm brace 78 which would also result in a counteracting moment indicated by moment arrow M2. The third way is simply a combination of both of the first two methods for counteracting the moment represented by moment arrow M1. In all of the methods, torque is applied to the handle but no significant torque can be transmitted from the handle 40 to the riser 12 or vice versa. Consequently, the sighting line always coincides with the center plane of the bow.

Referring again to FIGS. 2–4, the arm brace 78 is firmly attached to the handle 40. In addition to its utility in terms of counteracting the moment represented by moment arrow M1 (FIG. 5), the arm brace 78 serves as an arm guard to prevent the string 22 from striking an archer's forearm. From the standpoint of a bowhunter who is dressed warmly with one or more layers of clothing on his forearm, the arm brace 78 serves to compress these layers of clothing and keep them out of the path of the string as it moves forward. Referring to FIG. 4, stops 80 and 82 are illustrated for limiting the degree of rotational movement afforded to the handle 40. The stops 80 and 82 are secured, at one end, to a plate 84 which is, in turn secured to the handle 40. The stops extend towards the lower riser bracket 42 from the plate 84. The handle 40 can be rotated somewhat in either direction from the position illustrated in FIG. 4 (where the center plane of the handle is parallel to the center plane of the bow 10). Rotational movement of the handle will be limited when the free end of either one of the stops 80 and 82 contacts the lower riser bracket. It will be appreciated that the stops could alternatively be connected to the riser bracket 42 with a free end supported near the plate 82. Other manners and mechanisms for limiting rotational movement of the handle 40 will occur to those skilled in this art.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

I claim:

1. A compound archery bow having a center plane, said bow comprising a riser and limb assembly wherein said limbs are supported on said riser at a given limb angle for action about limb pivots, cams secured to said limbs, a bowstring a grip assembly, said grip assembly comprising a handle having a center plane and a low point, said handle being secured to and supported on said riser so that forces applied to said handle act on said riser through at least one point which is substantially coincident with the center plane of said bow, and string stop means for limiting over travel of said bow string after release of an arrow, wherein said riser is constructed so that the bow has a brace height, when strung with said bow string, which is at least one inch less than seven inches and wherein the distance between said bowstring and said at least one point is substantially equal to the brace height and wherein said riser is constructed so that the limb pivots are at least one inch forward, relative to the handle low point and said at least one point, of the corresponding position that said limb pivots would have in a conventional bow with a brace height of approximately seven inches, wherein the bow has a standard rated velocity which is at least six feet per second faster than a conventional bow comprising a conventional riser, said cams and said limbs and having a brace height of substantially seven inches and having a limb angle corresponding with the given limb angle, when strung with said bowstring.

2. The bow claimed in claim 1 wherein said low point of said handle is offset a substantial distance from the center plane of the bow, and said handle is pivotally connected to said riser for pivotal movement about at least one point which is coincident with the center plane of said bow.

3. The archery bow claimed in claim 2 which further comprises an arm brace secured to said handle and pivotable therewith.

4. The archery bow claimed in claim 1 wherein said string stop is operable, when said bow string is at rest, to preload said bow string.

5. A compound archery bow having a center plane, said bow comprising a riser and limb assembly wherein said limbs are supported on said riser at a given limb angle for action about limb pivots, cams secured to said limbs, a bowstring a grip assembly, said grip assembly comprising riser hinge means, a handle having a center plane and a low point, handle hinge means for pivotally supporting said riser relative to said handle so that forces applied to said handle act on said riser through at least one point which is coincident with the center plane of said bow, said riser hinge means and .said handle hinge means being connected for pivotal movement about an axis coincident with the bow center plane and said at least one point through which forces applied to said handle act on said riser, wherein said handle low point is offset a substantial distance from the center plane of said bow, wherein said riser is constructed so that the bow has a brace height, when strung with said bow string, which is at least one inch less than seven inches and wherein the distance between said bowstring and said at least one point is substantially equal to the brace height and wherein said riser is constructed so that the limb pivots are at least one inch forward, relative to the handle low point and said at least one point, of the corresponding position that said limb pivots would have in a conventional bow with a brace height of approximately seven inches, wherein the bow has a standard rated velocity which is at least six feet per second faster than a conventional bow comprising a conventional riser, said cams and said limbs and having a brace height of substantially seven inches and having a limb angle corresponding with the given limb angle, when strung with said bowstring.

6. The bow claimed in claim 5 which further comprises string stop means for limiting over travel of said bow string after release of an arrow.

7. The archery bow claimed in claim 6 wherein said string stop is operable, when said bow string is at rest, to preload said bow string.

8. The archery bow claimed in claim 5 which further comprises an arm brace secured to said handle and pivotable therewith.

* * * * *